US011766096B1

(12) United States Patent
Ben-Arie

(10) Patent No.: US 11,766,096 B1
(45) Date of Patent: Sep. 26, 2023

(54) BUTTON FASTENING KIT-III

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

(21) Appl. No.: 18/131,883

(22) Filed: Apr. 7, 2023

Related U.S. Application Data

(63) Continuation-in-part of application No. 17/829,364, filed on Jun. 1, 2022, now Pat. No. 11,666,121.

(51) Int. Cl.
*A44B 1/32* (2006.01)

(52) U.S. Cl.
CPC ..... *A44B 1/32* (2013.01)

(58) Field of Classification Search
CPC ..... A44B 1/32
See application file for complete search history.

(56) References Cited

U.S. PATENT DOCUMENTS 1,277,595 A * 9/1918 Jaffe ..... A44B 1/34 24/108
3,623,192 A * 11/1971 Papazian ..... A44B 1/34 411/510
3,982,013 A 9/1976 Katsuda
4,033,012 A 7/1977 Kramer
4,194,272 A * 3/1980 Taffurelli ..... A44B 1/34 411/510
4,512,063 A 4/1985 Fukuroi
4,662,034 A * 5/1987 Cunningham ..... A44B 1/28 24/94
4,751,780 A 6/1988 Trolltsch et al.
4,928,362 A 5/1990 Collas
5,107,573 A * 4/1992 Zhang ..... A44B 1/32 24/708
5,575,043 A 11/1996 Candotti
5,584,104 A * 12/1996 Stuart ..... A44B 1/185 24/104
5,940,940 A 8/1999 Tanikoshi
5,975,398 A 11/1999 Evans
6,702,162 B1 * 3/2004 Hassid ..... A41H 37/008 223/1
8,241,308 B2 * 8/2012 Kortenbach ..... A61B 17/068 606/220
8,522,404 B2 * 9/2013 Matei ..... A44B 1/28 24/104
8,938,861 B1 1/2015 McLendon
9,820,520 B2 11/2017 Bolen
(Continued)

*Primary Examiner* — David M Upchurch

(57) ABSTRACT

The kit comprises a fastening structure and an anchoring structure. The fastening structure includes two vertical poles which are connected at their top ends by a horizontal bar and are inserted into two apertures of the button. The lower ends of the poles are attached to terminal elements. The anchoring structure comprises two trapping mechanisms which are configured to trap the terminal elements and to prevent them from detachment once they reach their trapping spots. The user places the fastening structure with the button above the doth at the desired location and places the anchoring structure below the doth opposite to the terminal elements. Next, the user pushes the poles downwards pierces the doth and permanently traps the terminal elements by inserting them into the trapping mechanisms until they reach their trapping spots in which the resilient gates are released and occupy the cavities of the terminal elements.

7 Claims, 6 Drawing Sheets

(56) References Cited

U.S. PATENT DOCUMENTS

| | | | | |
|---|---|---|---|---|
| 9,861,167 | B2 * | 1/2018 | Shirai | A44B 1/34 |
| 10,004,299 | B2 | 6/2018 | Maussen | |
| 10,070,697 | B1 * | 9/2018 | Melgoza | A44C 3/001 |
| D842,165 | S * | 3/2019 | Marin | D11/228 |
| 10,455,901 | B2 * | 10/2019 | Marin | A44B 1/34 |
| 2005/0188510 | A1 | 9/2005 | Retamal | |
| 2010/0236029 | A1 * | 9/2010 | Mattei | A44B 1/28 24/114.4 |
| 2019/0029370 | A1 * | 1/2019 | Malvar | A44B 1/28 |

* cited by examiner

BUTTON FASTENING KIT-III

CROSS-REFERENCE TO RELATED APPLICATIONS

This Application is a continuation in part of application Ser. No. 17/829,364 filed on Jun. 01, 2022.

FEDERALLY SPONSORED RESEARCH

Not Applicable.

Sequence Listing or Program

Not Applicable.

TECHNICAL FIELD

The present invention relates to Kits for Buttons Fastening to Garment Cloths.

PRIOR ART

Traditionally buttons are attached to garments by sewing threads. However, sewing buttons is quite slow and laborious. Furthermore, threaded buttons tend to detach and fall frequently. Most garment owners don't know how to refasten and sew fallen buttons. Hence, a Kit for simpler, faster and more robust button re-attachment could be quite useful and can yield a notable improvement. In our search we have found several inventions of button assemblies that were configured for fast button attachment but all of them are not designed for button reattachment. In addition, they are dissimilar to our invention both in their structures and in their principles of operation. Most, if not all of these attachment assemblies rely on some sort of metallic pedestal crimping in order to attach the button to the garment doth. In U.S. Pat. No. 4,033,012 (Jul. 5, 1977) to Kramer et al. teaches a metallic button held by a metallic pedestal that is stapled to the garment doth by a four legged metallic staple that is crimped to hold the pedestal. In U.S. Pat. No. 8,522,404 (Sept. 3, 2013) Matei teaches a button which can be tilted because it is attached to an elongated metallic shaft with ball attached at one end. The ball is housed in a ball bearing cavity included in the mounting base attached to the garment. In US 2005/0188510 (Sept. 01, 2005) Retamal teaches a button attached to an elongated serrated metal shaft which fits into a serrated metal nut attached to the garment. In U.S. Pat. No. 4,751,780 (Feb. 25, 1986) Fukuroi teaches a metal button which is attached to a mounting base by a crimped metal nail. In U.S. Pat. No. 4,512,063 (Apr. 23, 1985) Fukuroi teaches a metal button attachment to a base by a metal rivet. In U.S. Pat. No. 5,575,043 (Nov. 19, 1996) Candotti also teaches a metal button attachment to a base by a metal rivet. In U.S. Pat. No. 4,928,362 (May 29, 1990) Collas proposes to mount a metallic button on a metallic shank which is connected to a disk beneath the garment doth. In U.S. Pat. No. 5,940,940 (Aug. 24, 1999) Tanikoshi teaches a button mounting by crimping a metal tubular rivet. In U.S. Pat. No. 5,975,398 (Nov. 02, 1999) Evans proposed attaching buttons to clothing by H shaped plastic studs which are inserted through the button holes into the clothing. In U.S. Pat. No. 9,820,520 (Nov. 21, 2017) Bolen teaches an attachment system with two parts one part attaches to the clothing side and the other part attaches to the button side and both parts are then coupled by a magnetic twist-lock mechanism. In U.S. Pat. No. 10,004,299 (Jun. 26, 2018) Maussen Teaches a tapered trapezoidal shape buttons which are connected to fabrics using sewing. IN U.S. Pat. No. 3,982,013 (Jul. 1 1975) Gould teaches a button attachment using a rivet with long serrated shaft that protrudes from the clothing and is attached to a button with fitting aperture. In U.S. Pat. No. 8,938,861 (Jan. 27, 2015) McLendon teaches a removably attachable button using a pair of U-shaped flexible pins with small hooks at their ends, which are inserted through the clothing and through the buttonholes. All the above inventions are entirely dissimilar to our invention.

BRIEF SUMMARY OF THE INVENTION

I have several goals in inventing and developing the Button Assembly kit of which some feasible embodiments are illustrated in FIGS. 1-9. The goals are:

1. To develop a Button Assembly Kit which facilitates easy manual permanent and robust attachment of the button to a garment doth without any need for sewing, threads or metal crimping.
2. To design components of a Button assembly kit which facilitate fast easy manual Button fastening without needing additional tools or machines.
3. To configure a fastening structure which can be attached swiftly, firmly and permanently to cloths.
4. To design an anchoring structure (i.e. a structure which anchors the button to the doth) which fastens the button to the doth by trapping the fastening structure that is tied to the button.
5. To include manually operated trapping mechanisms which reside in the anchoring structure and are configured to trap and robustly hold the fastening structure.
6. To design trapping mechanisms which can withstand without detachment strong pulling forces when applied to the button.
7. To design a button assembly which could be manufactured inexpensively with mass production from common elastic materials such as plastics.
8. To configure an anchoring structure that includes a trapping mechanism which exploits the resiliency of gates made of materials such as plastics to trap a terminal element which is attached to the fastening structure. Thereby, robustly tying the button to the garment doth.
9. To facilitate easy buttoning by configuring a fastening structure which includes Spacing Double Rings which introduce a buttoning gap between the button and the clothing.
10. To configure piercing cones which are attached to the bottom of the fastening structure and facilitate piercing of the garment doth during manual attachment of the fastening structure to the garment doth.
11. To configure an anchoring structure which houses trapping mechanisms which efficiently trap the fastening structure using resilient gates which lock into cavities constructed in the fastening structure.
12. Configuring a limiting strip which is installed inside the anchoring structure and limit sideway motions of the terminal elements of the fastening structure and prevents unwanted release of the captured fastening structure from the trapping mechanisms.
13. Attaching to the bottom of the anchoring structure a preventive arch which protects the user from the sharp ends of the piercing cones which protrude from the bottom of the anchoring structure. At final stage it is recommended to cut off the protective arch from the anchoring structure along with the sharp ends.

In order to achieve the objectives listed above, our method for button fastening to the garment doth is to tie the button to a fastening structure which includes at least two poles which are anchored to the doth by an anchoring structure. In our approach, the bottom ends of the poles of the fastening structure are attached to terminal elements. The fastening of the button to the doth is facilitated by trapping the fastening structure's terminal elements using trapping mechanisms housed in the anchoring structure which is placed beneath the doth. The trapping mechanisms use resilient gating technique where the action of trapping is activated by a forceful intrusion of each of the terminal elements into a separate trapping mechanism. Each trapping mechanism includes a pair of resilient gates which are attached diagonally to the walls of the anchoring apertures beneath their top openings. The intrusion of a terminal element bends the diagonal resilient gates which reside inside the two anchoring apertures which are housed in the anchoring structure. The anchoring structure is placed beneath the doth with its anchoring apertures residing opposite to the terminal elements. After piercing the doth, when a terminal element is inserted into its trapping mechanism and reaches its trapping spot, the bent resilient gates are configured to unbend and be released into a hook like cavities which are engraved into the terminal element. The released and unbent resilient gates which are stuck into the hook like cavities trap the terminal elements of the fastening structure and prevent them from retreating upwards. The trapping mechanisms are designed to act in Unisom. The cavities engraved at the terminal elements are configured to move in parallel such that all the cavities reach at the same instant their trapping spots i.e. arriving below the tips of the maximally bent gates. As an upshot, all the resilient gates unbend and are released into their corresponding cavities at the same instant. The released gates unbend due to their elasticity and turn inwards into their corresponding cavities thereby trapping the terminal elements which are tied to the button via the fastening structure.

In other words, when the terminal elements which are attached to the ends of the poles of the fastening structure are pushed downwards into the anchoring structure apertures which house the trapping mechanisms, all the terminal elements attached to the poles of the fastening structure are simultaneously trapped. Since the anchoring structure resides beneath the doth, the button which is fastened to the anchoring structure is fastened to the doth as well.

The fastening of the button to the garment doth is performed as follows: The button assembly is configured to be used for fast attachment of the button to the garment doth by placing the anchoring structure below the garment doth such that the two anchoring structure's anchoring apertures are facing a lower side of the garment doth while placing the fastening structure at an upper side of the garment doth such that its two terminal elements are situated opposite to the two corresponding anchoring structure's apertures. Next, pushing downwards the fastening structure from the upper side of the garment doth is configured to pierce the garment doth by the two pointed cones which are attached to the lower sides of the terminal elements. Further pushing downwards the fastening structure inserts the two terminal elements into the two trapping mechanisms housed at the two anchoring structure's anchoring apertures which are situated beneath the lower side of the garment doth. Inserting the two terminal elements further downwards through the two anchoring apertures of the anchoring structure is configured to bend the two pairs of resilient gates of the two trapping mechanisms and to trap the two terminal elements with the two trapping mechanisms which reside inside the two anchoring apertures of the anchoring structure. The two terminal elements are trapped when they reach the trapping spots in which the resilient gates can unbend and their tips are released into cavities which are engraved in the terminal elements. The two cavities have kind of slanted parallelogram cross sections which facilitate trapping of the two pairs of resilient gates after they unbend and enter the cavities. Each cavity is supported by an inner vertical wall at the cavity's center. The support is needed to prevent collapsing of the terminal element when it is vertically pressured during doth piercing. The inner vertical support walls divide each cavity into two compartments which are configured to trap a pair of resilient gates. The two pairs of released, resilient trapping gates trap the two terminal elements and prevent them from moving upwards. Downwards motion of the captured terminal elements is also restricted by the protecting arch which is installed beneath the two apertures and blocks the terminal elements' any further downwards motion. At that point, the two trapped terminal elements which are attached to the fastening structure are configured to prevent detachment and separation of the fastening structure from the anchoring structure and from the garment doth. Since the fastening structure is engaging the button's top, it also prevents detachment of the button from the doth. Thereby, completing the attachment of the button to the garment doth by permanently attaching the fastening structure to the garment doth.

The current invention also introduces two important improvements. The first improvement is the introduction of a separating strip and the second improvement is the introduction of a protective arch.

The separating strip is installed as a separator between the left anchoring aperture and the right anchoring aperture in the anchoring structure. The main function of the separating strip is to severely restrict sideways motions of the left terminal element and the right terminal element after they were trapped in the left anchoring aperture and the right anchoring aperture respectively. Unrestricted sideways motions often result in unwanted release of the captured left terminal element or the captured right terminal element.

The protective arch is attached to the bottom side of the anchoring structure with the goal to protect the user from the pointed left end of the left cone and from the pointed right end of the right cone. These pointed ends protrude after capturing from the bottom side of the anchoring structure. The protective arch also has another function which is to block further downwards motion of the captured terminal elements after their capture. finally, in order to reduce the total size of the anchoring structure and also as a safety precaution it is recommended to cut off the protective arch along with the pointed left end of the left cone and the pointed right end of the right cone which protrude from the bottom side of the anchoring structure.

DETAILED DESCRIPTION OF THE DRAWINGS

Figure 1:
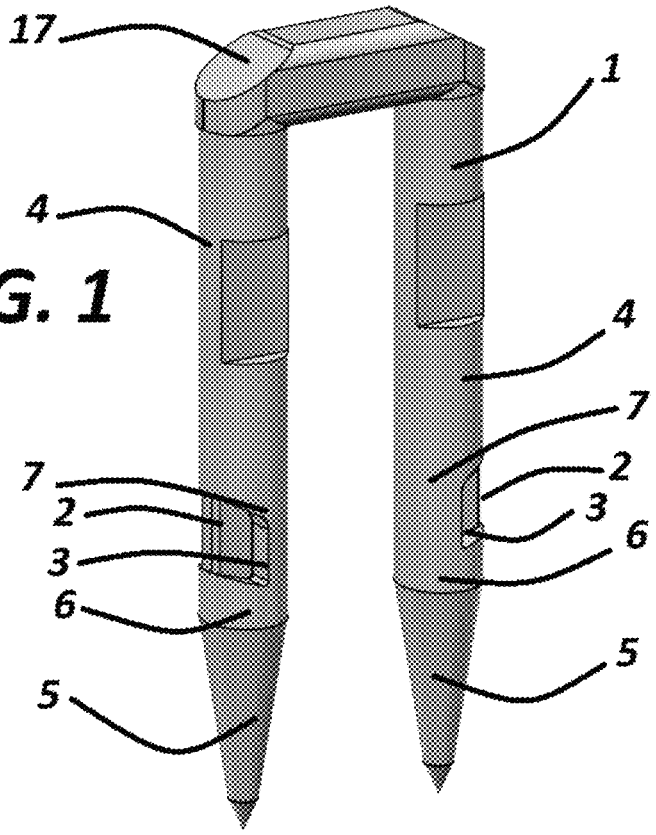
FIG. 1 displays a side view of an embodiment of the fastening structure in 3D isometric drawing.

FIG. 1 displays a side view of an embodiment of the fastening structure 1 in 3D isometric drawing. The two vertical poles 4 have cylindrical shape except for two flat patches that are needed for the molding process. The vertical poles are attached at their top ends to a horizontal bar 17 which after installation engages the upper surface of the button 11. At their bottom ends the poles 4 are attached to the upper ends of cylinders 7. Each cylinder has an engraved cavity 3. Each cavity 3 has a central vertical wall 2 which is configured to support its cavity 3 and the cylinder 7 against collapsing when pressurized. The left cylinder has an engraved cavity 3 with an opening facing leftwards whereas the right cylinder 7 has an engraved cavity 3 with an opening facing towards the right. The bottom ends of the cylinders 7 are attached to the upper sides of the terminal cylinders 6 which are attached at their bottom ends to upper obtuse ends of two cones 5 which have their pointed ends pointing downwards. The two flat engravings patches at the upper surfaces of the poles 4 were introduced in order to facilitate ejection of the poles 4 from the mold and do not have any functional role. The left terminal element comprises of the left cylinder 7, the left terminal cylinder 6 and the left cone 5. The right terminal element comprises of the right cylinder 7 the right terminal cylinder 6 and the right cone 5.

Figure 2:
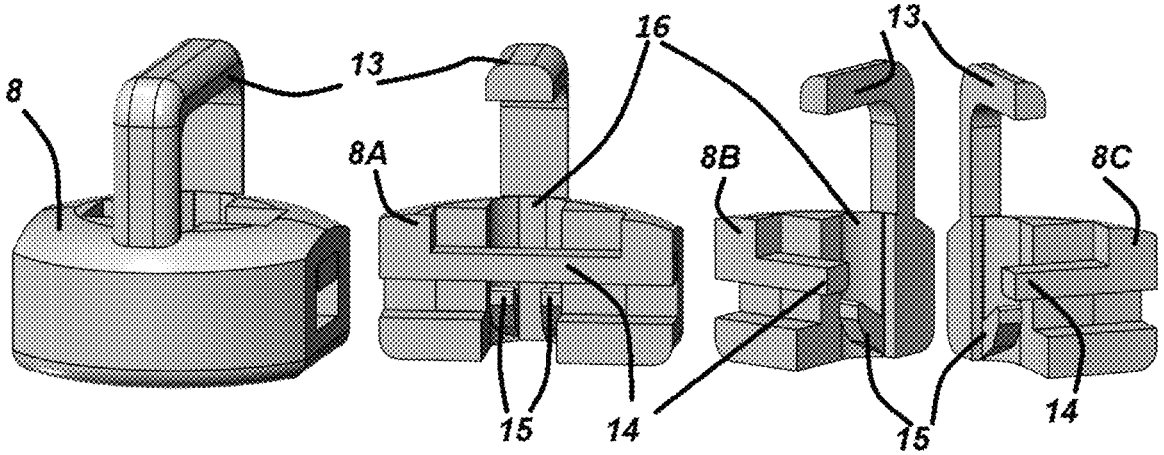
FIG. 2 Depicts in 3D isometric drawing an upside down frontal view of an embodiment of the anchoring structure which includes two trapping mechanisms inside two anchoring apertures. In order to better desctibe the inner structure of the anchoring apertures a half and two quarters cross sections of the anchoring structure are also displayed.

FIG. 2 Depicts in 3D isometric drawing an upside-down frontal view of an embodiment of the anchoring structure 8 which includes two trapping mechanisms inside two anchoring apertures. A cross section 8A of the anchoring structure and 2 cross sections 8B and 8C of the cross section 8A are also displayed for improved illustration of the inner structure. Each of the anchoring apertures 16 has an upper opening 16. Below each of the upper openings 16 a pair of resilient gates 15 is diagonally attached to the walls of the anchoring apertures 16. The lower side of each gate is unattached. The left pair of gates is attached with a rightward diagonal orientation whereas the right pair of gates is attached with a leftward diagonal orientation. A horizontal separating strip 14 is installed as a separator between the left anchoring aperture 16 and the right anchoring aperture 16. The main function of the separating strip 14 is to severely restrict sideways motions of the left terminal element and the right terminal element after they were trapped in the left anchoring aperture and the right anchoring aperture respectively. Unrestricted sideways motions often result in unwanted release of the left terminal element or the right terminal element.

The protective arch 13 is attached to a bottom side of the anchoring structure 8 with the goal to protect the user from the pointed left end of the left cone 5 and from the pointed right end of the right cone 5, which protrude after capturing from the bottom side of the anchoring structure 8. The protective arch 13 also blocks further downward mot ion of the terminal elements after they were trapped.

Figure 3:
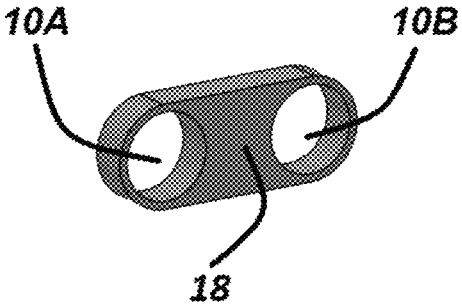
FIG. 3 Illustrates in 3D isometric drawing a frontal view of an embodiment of a double ring which is composed of a linked pair of spacing rings.

FIG. 3 Illustrates in 3D isometric drawing a front view of an embodiment of a double ring which includes a linked pair of spacing rings 10A, 10B plus a link which is denoted by 18. The spacing double rings are installed on the fastening structure 1 poles 4 beneath the button 11 and provide buttoning spacing between the button 11 and the doth 12.

Figure 4:
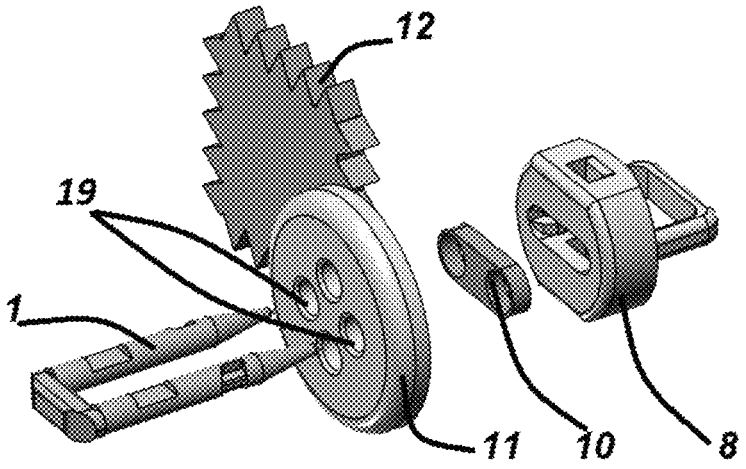
FIG. 4 Illustrates in 3D isometric drawing a top-side view of an embodiment of all the components used in a button fastening to a doth. This includes the fastening structure, the anchoring structure, the button, the spacing double rings and a piece of doth used for demonstration of garment doth attachment.

FIG. 4 Illustrates in 3D isometric drawing a side-top view of an embodiment which includes all the components used in a button fastening to a doth. This includes the fastening structure 1, the anchoring structure 8, the button 11, the double ring which includes two spacing rings 10 and a piece of doth 12. In FIG. 4 the fastening structure's left and right poles 4 have a horizontal orientation. The anchoring structure 8 is depicted at the right hand side of the fastening structure 1. The button 11 is lies vertically on the right hand side of the fastening structure. As shown in FIG. 4 the button 11 has four apertures 19. The double ring which includes two linked spacing rings 10 are displayed on the right-hand side of the button 11 and the piece of doth 12 is displayed on the right hand side of the button as well.

Figure 5:
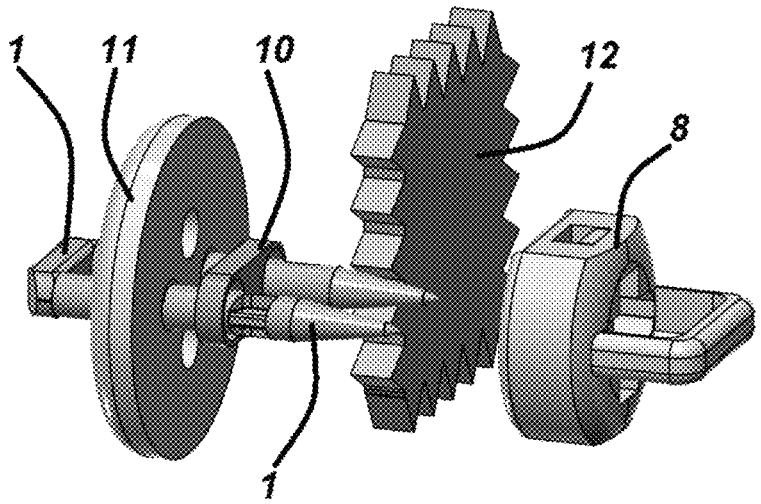
FIG. 5 illustrates in 3D isometric side view of the components required for the first step of button fastening demonstration in which the fastening structure is installed into the button's apertures and also into the spacing double rings apertures. The collection also includes the anchoring structure and the garment doth.

FIG. 5 illustrates in 3D isometric top view of a collection of components required for demonstration of a first step of a button fastening. The collection includes the fastening structure 1, the anchoring structure 8, the button 11, the double ring which includes two linked spacing rings 10 and the garment doth 12. In this depiction the fastening structure's left and right poles 4 have a horizontal orientation and are connected by their top ends to the horizontal bar 17. The anchoring structure 8 is depicted on the right-hand side of the fastening structure cones 5 which are attached to the front sides of the terminal cylinders 6. The upper sides of the terminal cylinders 6 are attached to the lower sides of the left and right cylinders 7 which are attached to the bottom sides of the poles 4. The button 11 is mounted on the poles 4 of the fastening structure 1. As shown in FIG. 4 the button 11 has four apertures 19. The double ring which includes two linked spacing rings 10 are also mounted on the poles 4 on the right-hand side of the button 11. The piece of doth 12 which is not penetrated yet by the cones 5, is displayed on the right hand side of the fastening structure 1. The anchoring structure 8 also is depicted at the right-hand side of the fastening structure 1.

Figure 6:
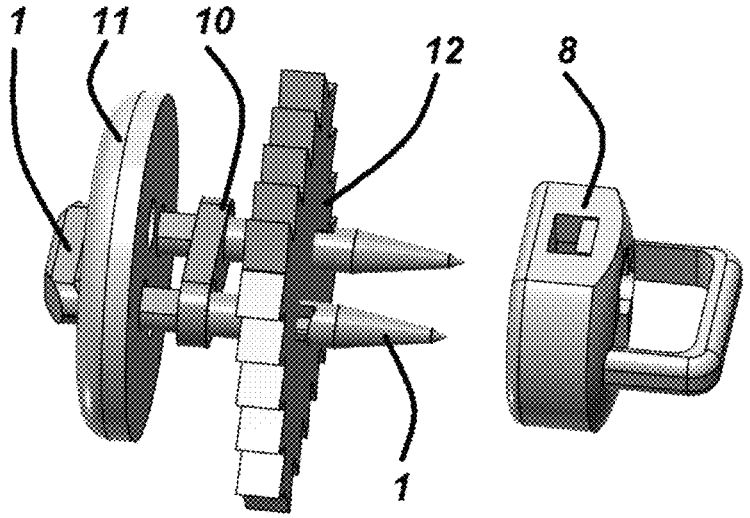
FIG. 6 depicts in 3D isometric side view of the components required for the second step of button fastening demonstration in which the fastening structure penetrates the doth after it was already installed into the button's apertures and into the spacing double rings apertures. The collection also includes the anchoring structure which is not used yet.

FIG. 6 illustrates in 3D isometric top view of a collection of components required for demonstration of a second step of a button fastening. The collection includes the fastening structure 1, the anchoring structure 8, the button 11, the double ring which includes two linked spacing rings 10 and the garment doth 12. In this depiction the fastening structure's left and right poles 4 have a horizontal orientation and are connected by their top ends to the horizontal bar 17. The anchoring structure 8 is depicted on the right-hand side of the fastening structure cones 5 which are attached to the bottom sides of the terminal cylinders 6. The upper sides of the terminal cylinders 6 are attached to the lower sides of the left and right cylinders 7 which are attached to the left and right bottom sides of the poles 4. The button 11 is mounted on the poles 4 of the fastening structure 1. As shown in FIG. 4 the button 11 has four apertures 19. The double ring which includes two linked spacing rings 10 are also mounted on the poles 4 on the right-hand side of the button 11. The piece of doth 12 which is already penetrated by the cones 5, is displayed on the right-hand side of the spacing double rings 10. The anchoring structure 8 is depicted at the right-hand side of the fastening structure 1.

Figure 7:
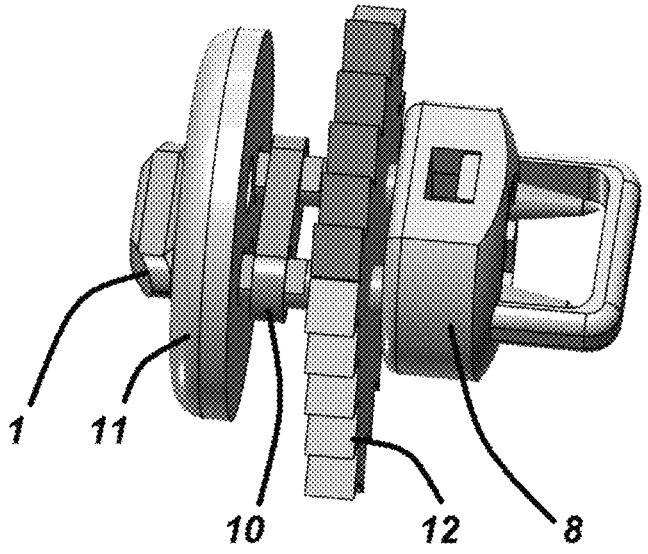
FIG. 7 shows in 3D isometric side view of the components required for the third step of button fastening demonstration in which the fastening structure penetrates the anchoring structure after it already pierced the doth and already was installed into the button's apertures and into the spacing double rings apertures.

FIG. 7 illustrates in 3D isometric top view of a collection of components required for demonstration of a third step of a button fastening. The collection includes the fastening structure 1, the anchoring structure 8, the button 11, the double ring which includes two linked spacing rings 10 and the garment doth 12. In this depiction the fastening structure's left and right poles 4 have a horizontal orientation and are connected by their top ends to the horizontal bar 17. The anchoring structure 8 is depicted on the right-hand side of the fastening structure cones 5 which are attached to the bottom sides of the terminal cylinders 6. The upper sides of the terminal cylinders 6 are attached to the lower sides of the left and right cylinders 7 which are attached to the left and right bottom sides of the poles 4. The button 11 is mounted on the poles 4 of the fastening structure 1. As shown in FIG. 4 the button 11 has four apertures 19. The double ring which includes two linked spacing rings 10 are also mounted on the poles 4 on the right-hand side of the button 11. The piece of doth 12 which is already penetrated by the cones 5, is displayed on the right-hand side of the double ring which includes two spacing rings 10. The anchoring structure 8 also is penetrated by the cones 5 and is depicted at the right-hand side of the fastening structure 1.

Figure 8:
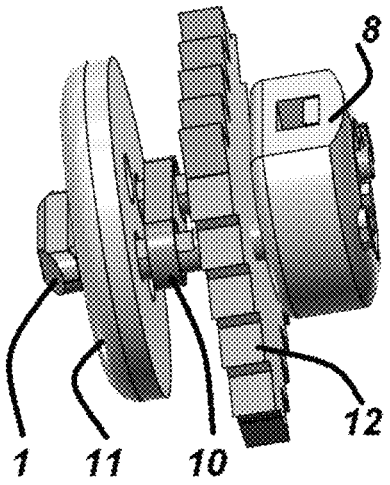
FIG. 8 shows in 3D isometric side view of the components required for the fourth and final step of button fastening demonstration in which the fastening structure already penetrated the anchoring structure after it already pierced the doth and already was installed into the button's apertures and into the spacing double rings apertures. The fourth step also includes cutting off the sharp ends of the terminal elements which were protruding from the bottom of the anchoring structure along with the protecting arch.

FIG. 8 illustrates in 3D isometric top view of a collection of components required for demonstration of a fourth step of a button fastening. The collection includes the fastening structure 1, the anchoring structure 8, the button 11, the double ring which includes two linked spacing rings 10 and the garment doth 12. In this depiction the fastening structure's left and right poles 4 have a horizontal orientation and are connected by their top ends to the horizontal bar 17. The anchoring structure 8 is depicted on the right-hand side of the fastening structure cones 5 which are attached to the bottom sides of the terminal cylinders 6. The upper sides of the terminal cylinders 6 are attached to the lower sides of the left and right cylinders 7 which are attached to the left and right bottom sides of the poles 4. The button 11 is mounted on the poles 4 of the fastening structure 1. As shown in FIG. 4 the button 11 has four apertures 19. The double ring which includes two linked spacing rings 10 are also mounted on the poles 4 on the right-hand side of the button 11. The piece of doth 12 which is already penetrated by the cones 5, is displayed on the right-hand side of the double ring which includes two spacing rings 10. The anchoring structure 8 also is penetrated by the cones 5 and is depicted at the right-hand side of the fastening structure 1. At this fourth and final step of a button fastening the user cuts off the protecting arch 13 along with the sharp ends of the cones 5.

Figure 9:
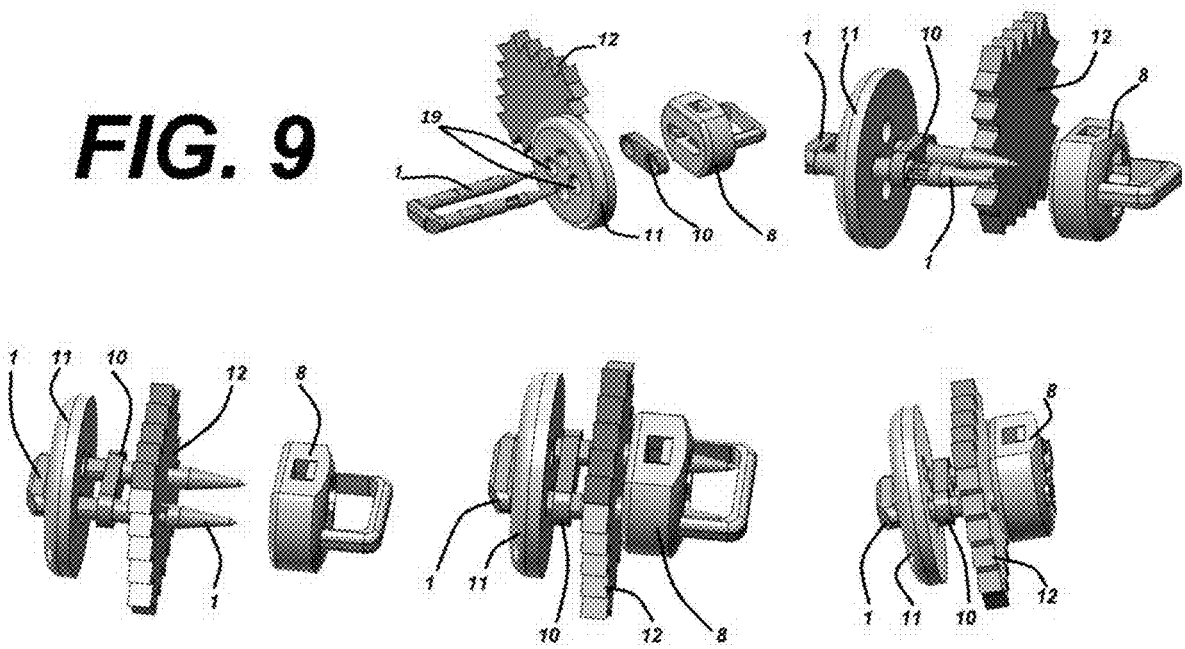
FIG. 9 Depicts an instruction page which includes all the steps required in a button installation. The page demonstrates the button installation by 3D isometric drawings.

FIG. 9 illustrates an instruction page which includes all the steps required in a button installation. The page demonstrates the button installation in 3D isometric drawings.

What is claimed is:

1. A button assembly configured for a button fastening on a doth;

wherein the button assembly comprises: the button, a fastening structure and an anchoring structure;

wherein the fastening structure comprising a left pole, a right pole, a horizontal bar, a left terminal element, a right terminal element and a double ring;

wherein the left terminal element includes a left cylinder with a left cavity, a left terminal cylinder and a left cone;

wherein the left cavity is supported at its center by a left vertical wall;

wherein a left cylinder lower end is attached to a top end of the left terminal cylinder; wherein the left cone has a pointed left end pointing downwards and an obtuse upper left end which is attached to a lower end of the left terminal cylinder; wherein the left cavity has a left oriented opening;

wherein the left terminal element has a left total height;

wherein the right terminal element includes a right cylinder with a right cavity, a right terminal cylinder and a right cone;

wherein the right cavity is supported at its center by a right vertical wall;

wherein a right cylinder lower end is attached to a top end of the right terminal cylinder; wherein the right cone has a pointed right end pointing downwards and an obtuse upper right end which is attached to a lower end of the right terminal cylinder; wherein the right cavity has a right oriented opening;

wherein the right terminal element has a right total height;

wherein the anchoring structure comprises a left anchoring aperture which houses a left trapping mechanism and a right anchoring aperture which houses a right trapping mechanism;

wherein the left anchoring aperture has a top left opening while the right anchoring aperture has a top right opening;

wherein the button is positioned horizontally and comprises a button's upper surface, a button's lower surface, a left buttoning aperture and a right buttoning aperture;

wherein the left pole is positioned vertically and configured to be inserted inside the left buttoning aperture;

wherein the right pole is positioned vertically and configured to be inserted inside the right buttoning aperture;

wherein the horizontal distance between the left pole and the right pole is defined as the horizontal buttoning distance;

wherein a top end of the left pole is attached to a left end of the horizontal bar;

wherein a top end of the right pole is attached to a right end of the horizontal bar;

wherein the horizontal bar is positioned engaging above the button's upper surface;

wherein the double ring has a left ring opening and a right ring opening;

wherein the left ring opening is configured to accommodate the left pole;

wherein the right ring opening is configured to accommodate the right pole;

wherein the distance between the left ring opening and the right ring opening is configured to be equal to the buttoning distance;

wherein a left cylinder's upper end is attached to a bottom end of the left pole;

wherein a right cylinder's upper end is attached to a bottom end of the right pole;

wherein the left terminal element is tied to the button via the left pole which is attached to the horizontal bar;

wherein the right terminal element is tied to the button via the right pole which is attached to the horizontal bar;

wherein the left trapping mechanism is configured to trap the left terminal element and prevent it from moving upwards when the left terminal element enters into the left trapping mechanism and reaches a left trapping spot;

wherein the left trapping spot is situated at the left total height below the left aperture opening;

wherein the right trapping mechanism is configured to trap the right terminal element and prevent it from moving upwards when the right terminal element enters into the right trapping mechanism and reaches a right trapping spot;

wherein the right trapping spot is situated at the right total height below the right aperture opening;

wherein the doth is placed and spread horizontally below the left terminal element and below the right terminal element;

wherein the left trapping mechanism is placed below the doth and opposite to the left terminal element;

when the left terminal element is pushed downwards, it is configured to pierce the doth and to enter into the left trapping mechanism and to get trapped after reaching the left trapping spot;

wherein the right trapping mechanism is placed below the doth and opposite to the right terminal element;

when the right terminal element is pushed downwards, it is configured to pierce the doth and to enter into the right trapping mechanism and to get trapped after reaching the right trapping spot;

wherein the button which is tied to the left terminal element and to the right terminal element is configured to be fastened on a top of the doth when the left terminal element and the right terminal element are pushed downwards and reach the left trapping spot and the right trapping spot respectively.

2. A button assembly of claim 1, wherein the anchoring structure comprises a left anchoring aperture and a right anchoring aperture;

wherein the left anchoring aperture has a top left opening and the right anchoring aperture has a top right opening;

wherein the left anchoring aperture houses the left trapping mechanism;

wherein the right anchoring aperture houses the right trapping mechanism;

wherein the left trapping mechanism is configured to trap the left terminal element inside the left anchoring aperture and to prevent it from moving upwards once the left trapping mechanism is activated; wherein the left trapping mechanism is activated when the left terminal element is inserted into the left trapping mechanism and reaches the left trapping spot;

wherein the right trapping mechanism is configured to trap the right terminal element inside the right anchoring aperture and to prevent it from moving upwards once the right trapping mechanism is activated; wherein the right trapping mechanism is activated when the right terminal element is inserted into the right trapping mechanism and reaches the right trapping spot;

wherein the button is configured to be fastened on the top of the doth by pushing simultaneously downwards the left pole and the right pole such that the left terminal element and the right terminal element move downwards and are configured to activate the left trapping mechanism and the right trapping mechanism respectively;

wherein when activated, the left terminal element and the right terminal element are configured to fasten the button to the anchoring structure and to the doth.

3. The button assembly of claim 1, wherein a left pole's radius of a left pole's minimal bounding cylinder is equal to a left terminal element's radius of a left terminal element's minimal bounding cylinder;

wherein a right pole's radius of a right pole's minimal bounding cylinder is equal to a right terminal element's radius of a right terminal element's minimal bounding cylinder.

4. The button assembly of claim 1, wherein a double ring height equals a distance between a double ring's upper side and a double ring's lower side;

wherein the double ring height is equal to a vertical buttoning spacing;

wherein the vertical buttoning spacing is configured to be larger than a thickness of the doth;

whereby, buttoning of the doth is facilitated by the vertical buttoning spacing.

5. The button assembly of claim 4, wherein a height of a bounding cylinder of the left pole is greater than the sum of a thickness of the button, the buttoning spacing and the thickness of the cloth;

wherein a height of a bounding cylinder of the right pole is greater than the sum of the thickness of the button, the buttoning spacing and the thickness of the doth.

6. The button assembly of claim 1, wherein the left trapping mechanism includes a first left gate and a second left gate;

wherein the first left gate and the second left gate are made of a resilient material; wherein an upper end of the first left gate and an upper end of the second left gate are diagonally attached to the left anchoring aperture below the upper left opening;

a lower end of the first left gate and a lower end of the second left gate are unattached; wherein the first left gate and the second left gate are spaced apart by a gap wider than a width of the left vertical wall and are attached in a right leaning diagonal orientation;

wherein both the first left gate and the second left gate are configured to bend diagonally leftwards when pressed downwards by the left terminal element; while bending leftwards, the first left gate and the second left gate are configured to facilitate a unidirectional downwards translation of the left terminal element via the upper left opening while moving towards the left trapping spot; when the left terminal element reaches the left trapping spot, the left oriented opening is configured to reach the lower end of the first left gate and the lower end of second left gate;

at that point, the lower end of the first left gate and the lower end of second left gate are configured to resiliently unbend rightwards and to insert the lower end of the first left gate and the lower end of second left gate into the left oriented cavity; thereby preventing the left terminal element from moving upwards and trapping the left terminal element in the left trapping spot;

wherein the right trapping mechanism includes a first right gate and a second right gate;

wherein the first right gate and the second right gate are made of the resilient material; wherein an upper side of the first right gate and an upper side of the second right gate are diagonally attached to the right anchoring aperture below the upper right opening;

a lower end of the first right gate and a lower end of the second right gate are unattached; wherein the first right gate and the second right gate are spaced apart by a gap wider than a width of the right vertical wall and are attached in a left leaning diagonal orientation;

wherein both the first right gate and the second right gate are configured to bend diagonally rightwards when pressed downwards by the right terminal element; while bending rightwards, the first right gate and the second right gate are configured to facilitate a unidirectional downwards translation of the right terminal element via the upper right opening while moving towards the right trapping spot;

when the right terminal element reaches the right trapping spot, the right oriented opening is configured to reach the lower end of the first right gate and the lower end of second right gate;

at that point, the lower end of the first right gate and the lower end of second right gate are configured to resiliently unbend leftwards and to insert the lower end of the first right gate and the lower end of second right gate into the right oriented cavity; thereby preventing the right terminal element from moving upwards and trapping the right terminal element in the right trapping spot.

7. The button assembly of claim 6, wherein the anchoring structure comprises a separating strip and a protective arch;

wherein the separating strip is installed as a separator between the left anchoring aperture and the right anchoring aperture; the main function of the separating strip is to severely restrict sideways motions of the left terminal element and the right terminal element after they were trapped in the left anchoring aperture and the right anchoring aperture respectively; unrestricted sideways motions often result in unwanted and premature release of the left terminal element or the right terminal element;

the protective arch is attached to a bottom side of the anchoring structure and is configured to protect the user from the pointed left end of the left cone and from the pointed right end of the right cone, which protrude from the bottom side of the anchoring structure after their trapping; finally, to reduce the total size of the anchoring structure and also as a safety precaution it is recommended to cut off the pointed left end of the left cone and the pointed right end of the right cone which protrude from the bottom side of the anchoring structure along with the protective arch.

* * * * *